US005275681A

United States Patent [19]

Hettler

[11] Patent Number: 5,275,681

[45] Date of Patent: Jan. 4, 1994

[54] METHOD AND DEVICE FOR ATTACHING TIE-ON TAGS TO CONTAINERS

[75] Inventor: Albert Hettler, Reutlingen, Fed. Rep. of Germany

[73] Assignee: Hettler Maschinen GmbH, Reutlingen, Fed. Rep. of Germany

[21] Appl. No.: 36,879

[22] Filed: Mar. 25, 1993

[30] Foreign Application Priority Data

Mar. 25, 1992 [DE] Fed. Rep. of Germany ..... 4209671

[51] Int. Cl.[5] ..... B65C 9/00

[52] U.S. Cl. ..... 156/297; 156/249; 156/552; 156/DIG. 23; 493/375; 53/291; 53/295

[58] Field of Search ..... 156/249, 297, 556, 566, 156/DIG.; 493/375, 376; 53/291, 292, 293, 294, 295

[56] References Cited

U.S. PATENT DOCUMENTS

| | | | |
|---|---|---|---|
| 4,578,139 | 3/1986 | Stehouwer | 493/375 X |
| 4,689,100 | 8/1987 | Coleman | 156/DIG. 23 X |
| 4,853,063 | 8/1989 | Basgil et al. | 156/249 X |
| 5,184,996 | 2/1993 | Rode et al. . | |

*Primary Examiner*—David A. Simmons
*Assistant Examiner*—James J. Engel, Jr.
*Attorney, Agent, or Firm*—Antonelli, Terry, Stout & Kraus

[57] ABSTRACT

The invention concerns a method for attaching tags (14) provided with closed loops (34), so-called tie-on tags, to the necks of containers (27, 27A).

Tags (14) of this type are usually slipped on by hand over the containers (27, 27A) passing by on an assembly line, which requires high numbers of employees.

The object of the invention to develop the method in such a way that the tags (14) can be automatically attached to the container necks is solved thereby that the tags (14) provided with loops (34) are aligned and placed in a row in a first procedural step, as well as fastened to at least one support band (16) and, in a second procedural step, a gripper (24) is inserted into each loop (34), each loop (34) is released from the support band (16), the gripper (24) with the loop (34) crosses over the neck of a container (27, 27A), that the loop (34) is released from the gripper (24) and the gripper (24) is moved away from the container (27, 27A).

Advantageous embodiments result from the use of two support bands (16), an adhesive connection between loops (34) and support bands (16) and the rewinding of the support bands (16).

A device for carrying out the method is also object of the invention.

15 Claims, 3 Drawing Sheets

METHOD AND DEVICE FOR ATTACHING TIE-ON TAGS TO CONTAINERS

DESCRIPTION

The invention concerns a method for attaching tie-on tags to the necks of containers according to the preamble of claim 1. In addition, the invention concerns a device for carrying out this method.

Tags provided with closed loops, so-called tie-on tags, are often attached to container necks to identify the contents of these containers. Typical examples of application are containers for foodstuffs, mineral oil products, other liquids or bulk goods.

The tie-on tags are usually slipped, by hand, over the necks of containers passing along on an assembly line. A separate person is required to do this; moreover, the work is extremely monotonous and tiring.

The object of the invention is to develop the method further so that it is possible to automatically attach the tags to the container necks as well as to create a device for carrying out the method.

This object is solved by the characterizing features of claim 1. Advantageous embodiments of the method and a device for carrying out said method can be found in the subclaims.

Figure 1:
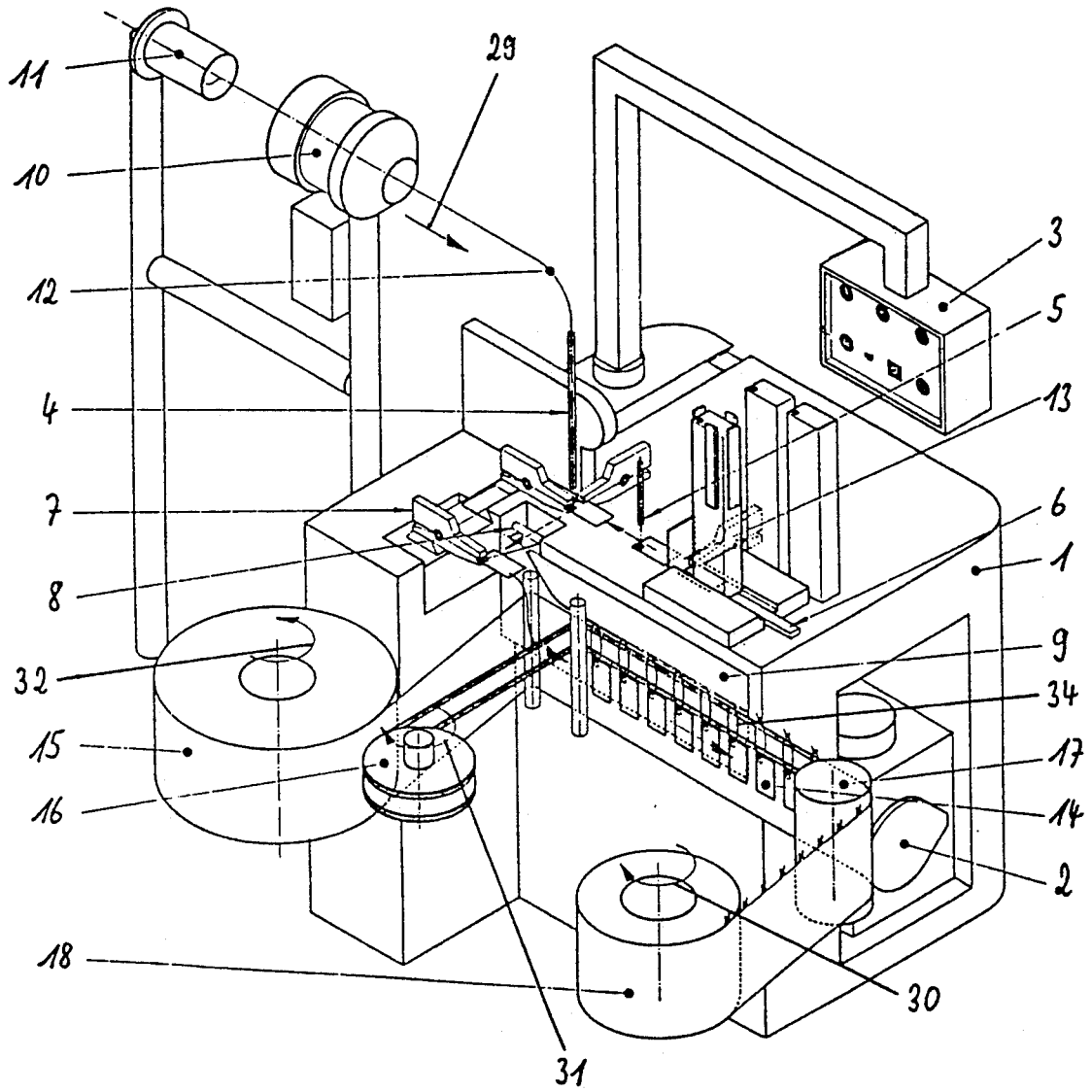
Figure 2:
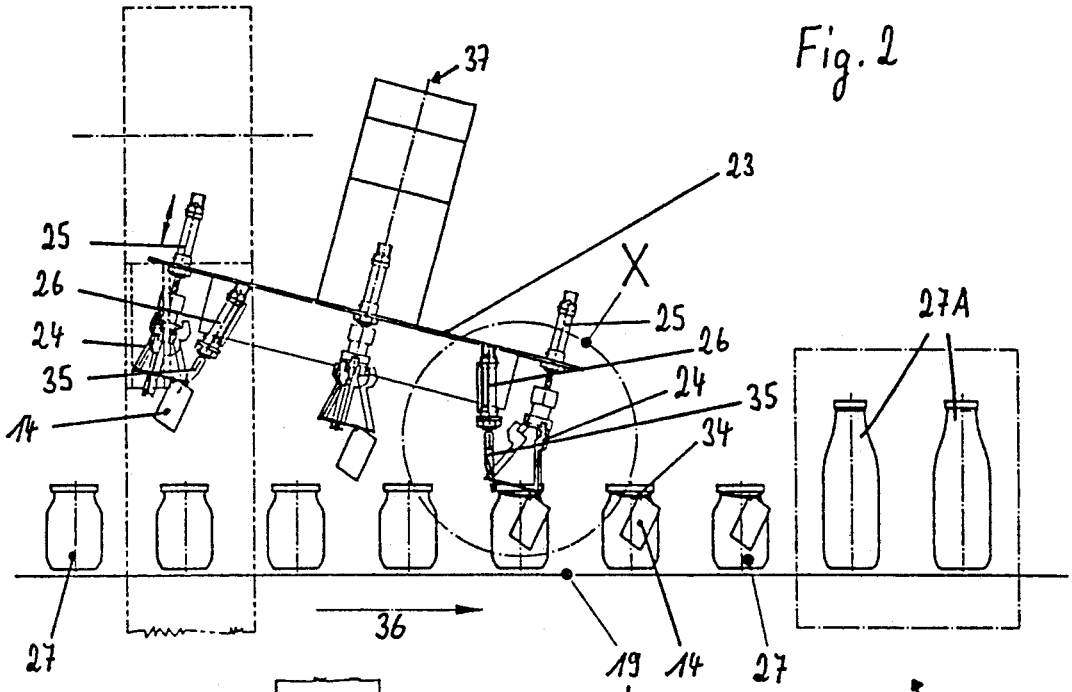
Figure 3:
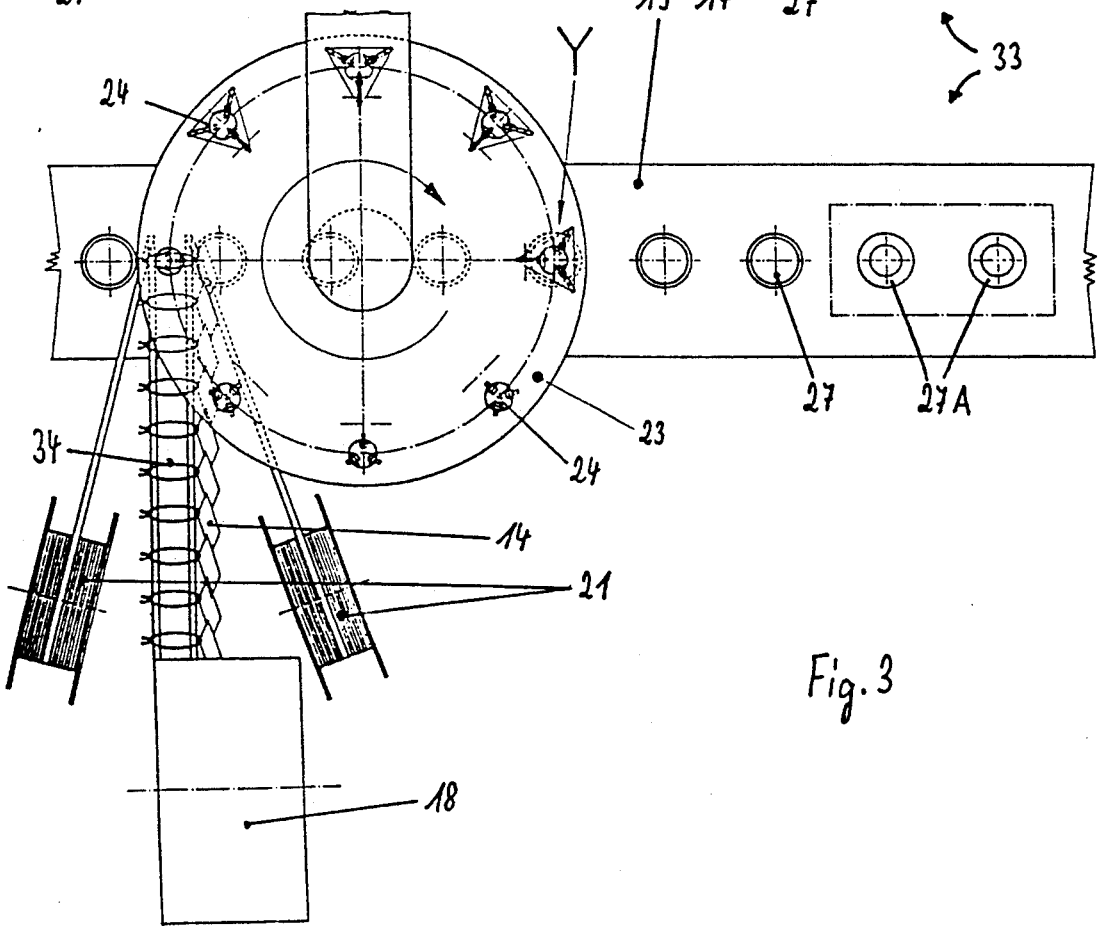
Figure 4:
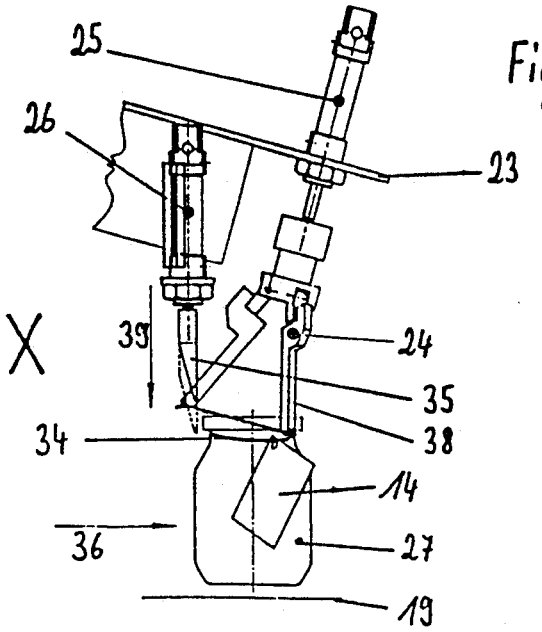
Figure 5:
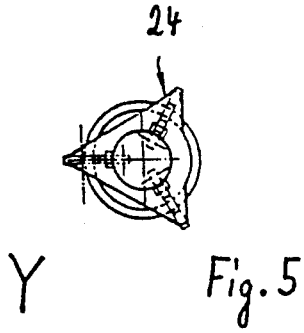
Figure 6:
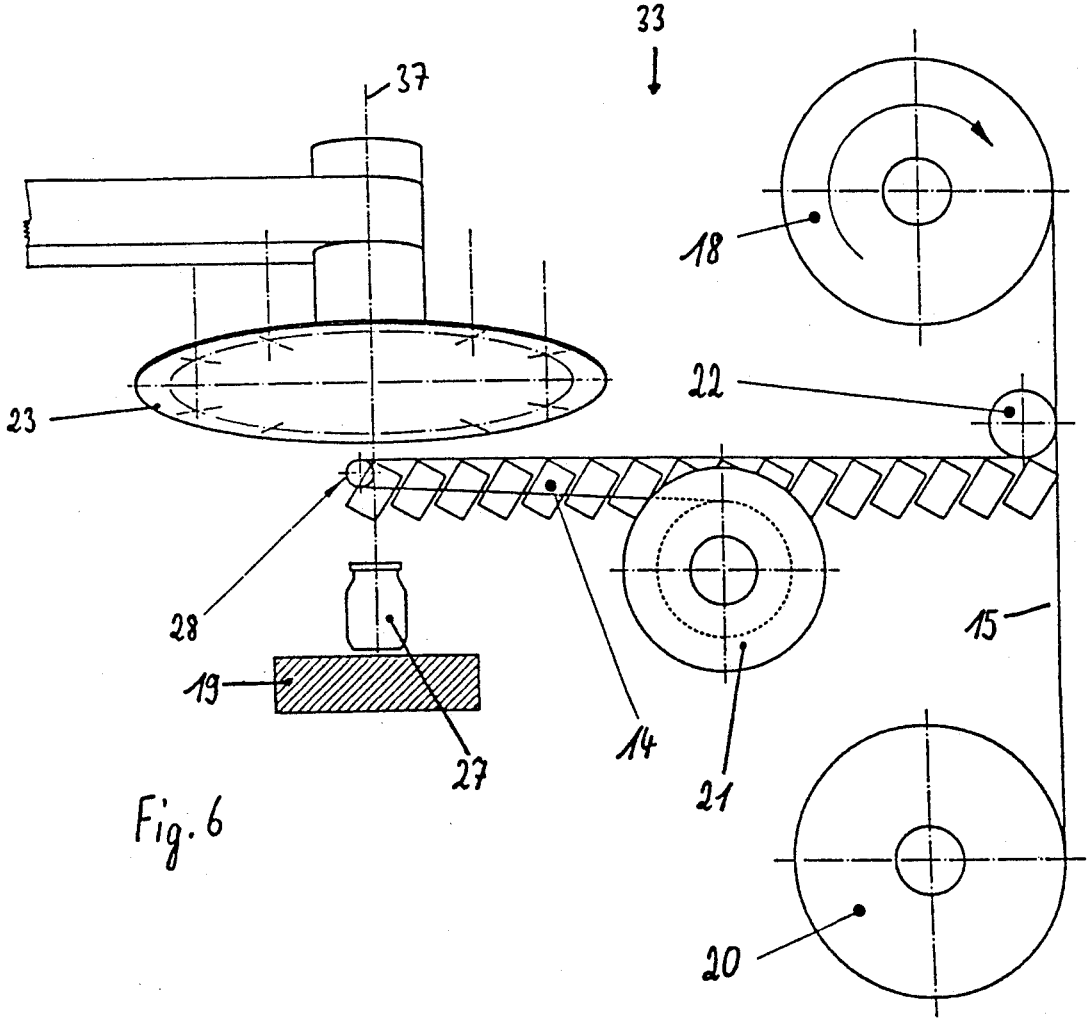

An embodiment of the invention shall be described in greater detail in the following with reference to the drawings, in which the same parts are designated by the same reference numbers, showing:

FIG. 1 a perspective representation of an automatic tag-making machine for carrying out the first procedural steps;

FIG. 2 a side view of the transfer station to carry out the further procedural steps;

FIG. 3 a view of the transfer station of FIG. 2, from the top;

FIG. 4 an enlarged representation of the detail X from FIG. 2;

FIG. 5 an enlarged representation of the detail Y from FIG. 3;

FIG. 6 the representation of some elements of the transfer station shown in FIGS. 2 and 3, from a perspective at right angles to these figures.

Essentially two machines are used to carry out the method, the automatic tag-making machine I shown in FIG. 1 and the transfer station 33 shown in FIGS. 2 to 6. With the automatic tag-making machines, the tags 14 provided with the closed loops 34 are uniformly aligned and placed in a row, fastened with their loops 34 to two support bands 16 and, together with a supporting foil 15, rolled up into a roll of tags 18. The tag roll 18 is then inserted in the transfer station 33 where it is unrolled and the released tags 14 are attached to the necks of containers 27.

The automatic tag-making machine 1 comprises a housing with a control panel 3 attached thereto in such a way that it can be tilted. The unfinished tags are pushed from a supply stack by means of a tag slider 6 to a perforating station 5 and perforated there. The perforated tags 14 are then held by tag pincers 7 and a thread 12 is pushed through the punched hole of each tag 14 via thread guide 4. This thread 12 is guided from a thread spool 11 via a thread feeder 10 in direction of arrow 29 to the automatic tag-making machine 1. When the thread 12 is in the hole of the tag 14, the knotter 8 goes into action and knots the two free ends of the thread together, as a result of which a loop 34 is formed.

The closed loops 34 of these tags 14 are then uniformly aligned and placed in a row along a guide plate 9 at a fixed distance from one another and connected with two parallel running adhesive tapes 16 which slide along the guide rail 9. These adhesive tapes 16 are unwound from a delivery spool in direction of arrow 31.

A supporting foil 15 is unwound from a further delivery spool in direction of arrow 32 and turned around in such a way that it slides between guide plate 9 and the two adhesive tapes 16. The speed of the supporting foil 15 along the guide plate 9 is thereby identical to that of the adhesive tapes 16 and tags 14. The loops 34 of tags 14 are between adhesive tapes 16 and the supporting foil 15. These three layers are led over a pressure and guide roller 17, as a result of which a firm, yet detachable bonding takes place, both between the adhesive tapes 16 and the loops 34 of the tags 14 and between the adhesive tapes 16 and the supporting foil 15. The conglomerate consisting of supporting foil, loops 34 and adhesive tapes 16 is then wound up into a tag roll 18 in direction of arrow 30. Thus, the first procedural step is completed and the tag roll 18 can now be temporarily stored until the second procedural step is carried out.

All subsequent procedural steps are carried out on a transfer station 33, which is shown in FIGS. 2 to 6. This transfer station 33 has a horizontally running conveyor belt 19 which moves at a constant speed and on which the containers 27 to be tagged are arranged at a fixed distance from one another. Above this conveyor belt 19, there is a rotating plate 23 whose axis 37 is essentially vertical yet slightly tilted. The lowest point of this rotating plate 23 is above the centre of the conveyor belt 19 in each case. Several grippers 24 and thread strippers 35 are attached to the underside of the rotating plate 23, that is, uniformly distributed along the periphery. The tag roll 18 is mounted in a suitable receptacle from which the band consisting of supporting foil 15, tags 14 with loops 34 and adhesive tapes 16 is unwound and fed essentially tangentially to the rotating plate 23. The feeding takes place at the highest point of the rotating plate 23 at that moment, that is, opposite to the above-noted lowest point of the rotating plate 23, also above the centre of the conveyor belt 19.

A side view of the transfer station 33 and a detailed view (detail X) are shown in FIGS. 2 and 4. The conveyor belt 19 runs in direction of arrow 36, that is, from left to right in FIG. 2. The swivel axis 37 of the rotating plate 23 is essentially at right angles, however, slightly tilted. The angle to the perpendicular line is about 15° in the illustrated embodiment. The swivel axis 37 forms a plane together with the direction of travel 36 of the conveyor belt 19, i.e. the swivel axis 37 is inclined in direction of travel 36 and not to the side. In the embodiment shown in FIG. 2, therefore, the lowest point of the rotating plate 23 at that moment with respect to the direction of travel 36 of the conveyor belt 19 is further in front than its highest point at that moment.

Eight grippers 24, each having a thread stripper 35, are uniformly spaced along the periphery of the rotating plate 23 and on its side facing the conveyor belt 19. The structure of such an arrangement consisting of grippers 24 and thread strippers 35 can best be seen in FIG. 4. Gripper 24 is fastened with a threaded pin in a bore of the rotating plate 23 and comprises three uniformly disposed spreader arms 38 which can be stayed outward. These spreader arms 38 are essentially parallel when at rest and can be spread apart and axially moved to the position shown in FIG. 4 by a first lifting cylinder 25. This first lifting cylinder 25 is operated, for example, hydraulically or by compressed air. A thread stripper 35, which comprises a second lifting cylinder 26, is situated close to the gripper 24 on the rotating plate 23. By operating this second lifting cylinder 26, the blade of this thread stripper 35 is pushed downward in direction of arrow 39 and comes in contact with one of the spreader arms 38 of the gripper 24, whereby it grips under the loop 34 and pushes it downward. All of the thread strippers 35 are, seen from the respective grippers 24, arranged radially inward on the rotating plate 23.

As can be seen in FIG. 3, the supporting foil 15, together with the tags 14 provided with loops 34 and adhesive tapes 16, are tangentially conveyed to the rotating plate 23 in the area of the grippers 24. When looking at this figure in combination with FIG. 6, it can be seen that the adhesive tapes 16 together with the tags 14 are detached from the supporting foil 15 with aid of the guide pulley 22, whereupon the supporting foil 15 is then wound up on the rewinding roller 20. The supporting foil 15 only touches the guide pulley 22 tangentially thereby, that is, continues to proceed essentially straight ahead to the rewinding roller 20. The adhesive tapes 16 with the tags 14 are led over a specific angular area via guide pulley 22, in the illustrated embodiment, this is about 90°. The adhesive tapes 16 now run together with the tags 14 over a guile pulley 28 below the rotating plate 23. Immediately in front of this guide pulley 28, the tags 14 are separated from the adhesive tapes 16, as described below, and the adhesive tapes wound up on rewinding rollers 21. The adhesive tapes 16 are thereby turned around at the guide pulley 28 by about 180° before they reach the rewinding rollers 21. The rewinding rollers 21 are attached on the side beside the path of the adhesive tapes 16 between guide pulley 22 and guide pulley 28.

The transfer station 33 functions as follows:

The rotating plate 23 turns about its axis 37 simultaneously with the linear conveyance of the containers 27 on the conveyor belt 19. Furthermore, the tag rolls 18 and the rewinding rollers 20 and 21 rotate. The band consisting of supporting foil 15, tags 14 and adhesive tapes 16 proceeds from the tag roll 18 to the guide pulley 22. At this guide pulley 22, the adhesive tapes 16 are detached together with the tags 14, the supporting foil 15 travels on alone and is wound up on the rewinding roller 20. The adhesive tapes 16 run together with the tags 14 from guide pulley 22 to guide pulley 28. Just prior to reaching guide pulley 28, the tags 14 with the loops 34 are removed from the adhesive tapes 16, the adhesive tapes 16 are sharply turned around and wound up on the two rewinding rollers 21.

The tags 14 with loops 34 are removed from the adhesive tapes 16 by grippers 24 arranged on the rotating plate 23. These are found in the area of the tag pick-up in a closed state, thus, the spreader arms 38 are essentially parallel to one another. Gripper 24 is now led into the loop 34 of tag 14 by operating a lifting cylinder 25 and then spread apart. In this way, the loop 34 is also spread apart and the tag 14 hangs securely with this loop 34 on the spreader arms 38 of gripper 24. If the rotating plate 23 has turned by 180° in the course of its continuous movement, then gripper 24 with tag 14 is at the lowest point of its path. Two of the three spreader arms 38 cross over the neck of the container 27 in this position, the third—the spreader arm 38 facing the thread stripper 35—is above the neck of the container 27. In this position, the thread stripper 35 is activated by its lifting cylinder 26. As a result, its blade moves downward in partial direction 39, grips under the loop 34 and pushes it downward over the uppermost spreader arm 38. This spreader arm 38 can thereby yield inward. Loop 34 is now on the side of the container 27 facing away from the thread stripper 35 on the neck of the container 27 and, on the opposite side, hangs on the blade of the thread stripper 35. As a result of the container 27 being conveyed forward on the conveyor belt 19 in direction of arrow 36, loop 34 becomes loose from the bevelled blade of the thread stripper 35 and the loop 34 is completely on the neck of the container 27.

The overall height of the rotating plate 23 is set in such a way that the two lower-lying spreader arms 38 of gripper 24 just cross over the neck of the container 27 at the lowest point in the path. In the event that containers of a different height (27A) are to be used, then the overall height of the rotating plate 23 is to be adapted to the height of these containers 27A.

In the illustrated embodiment, eight groupings consisting of grippers 24 and thread strippers 35 are mounted on the rotating plate 23. The grippers 24 seen in the upper half of the rotating plate 23 in FIG. 3 are spread apart and carry loops 34 of tags 14. This state of the grippers 24 is shown in detail in FIG. 5. The lower grippers 24 of FIG. 3 are driven together and ready to pick up new tags 14 in the transfer point. The speeds of tag roll 18, rotating plate 23 and conveyor belt 19, as well as the spacing of the loops 34 on the adhesive tapes 216, the grippers 24 among themselves and the containers 27 on the conveyor belt 19 are so accurately adjusted to one another that each subsequent gripper 24 can pick up the next tag 15 and the grippers 24 can transfer the tags 14 successively onto the containers 27.

In an alternative embodiment, the automatic tag-making machine 1 can be integrated in the transfer station 33. To accomplish this, the outlet of the automatic tag-making machine 1 is led directly to the inlet of the transfer station 33 and not to a roll of tags 18.

In another alternative embodiment, an endless conveyor belt can be used instead of the rotating plate 23. Preferably, this conveyor belt runs above the conveyor belt 19 and diagonally thereto and is in a plane with the conveyor belt 19. Grippers 24 and thread strippers 35 are found on the outside of this belt. The path of the belt asymptotically approaches the path of the containers 27 on conveyor belt 19 and the speed of the belt corresponds to the speed of conveyor belt 19. The grippers 24 arranged on the belt are equipped similarly as in the embodiment discussed in detail above. When the speed of the belt and the conveyor belt 19 is the same, the distance between two successive grippers 24 must also be identical in each case to the distances between two successive containers 27. When the speed of the endless belt and the conveyor belt 19 are different, then the spaces between the grippers 24 must also differ accordingly from those of the containers 27, so that, in a continuous operation, a gripper 24 always reaches a container 27 at the appropriate time.

I claim:

1. A method of attaching tags provided with closed loops to the necks of containers, the tags being uniformly aligned and placed in a row, comprising the steps:

(a) fastening a loop to at least one support band;

(b) inserting a gripper into the loop;

(c) detaching the loop from the support band (d) slipping the loop over the neck of a container by the gripper, and (e) detaching the loop from the gripper and leading the gripper away from the container.

2. A method as defined in claim 1, wherein in step (a) the loop is fastened to two support bands spaced from one another prior to detachment therefrom.

3. A method as defined in claim 1, including the step, after the gripper has been inserted into the loop of winding up the support band on a rewinding roller.

4. A method as defined in claim 1, in which in step (a) the loop is fastened to the at least the one support band by a detachable adhesive connection.

5. A method as defined in claim 1, including the step of releasing the loop from the gripper by stripping the loop off from the gripper by means of a thread stripper.

6. A method as defined in claim 1, wherein the tags are aligned and placed in a row and the loops are fastened to the at least the one support band in a first procedural step, and wherein the support band with the loops and the tags are wound up together with a supporting foil and temporarily stored and the remaining steps take place in an independent second procedural step.

7. A method as defined in claim 6, wherein the supporting foil, after the support bands with the tags have been removed, is wound up on a guide pulley in the second procedural step.

8. A device for carrying out the method of claim 1 comprising:

(a) an automatic tab-making machine for finishing and uniformly placing the tags provided with closed loops in a row;

(b) a horizontally travelling conveyor belt for uniformly conveying the containers arranged at fixed distances thereof;

(c) an endless conveying device which is above the conveyor belt and extends diagonally thereto, whereby the lowest point of the conveying device is above the centre of the conveyor belt;

(d) a plurality of grippers which are equidistantly spaced along the endless conveying device pointing in direction of the conveyor belt; and (e) a feed for the support band having the loops with tags fastened thereto which reaches the endless conveying device essentially tangentially and in the area of the highest gripper at that moment.

9. A device as defined in claim 8, wherein the endless conveying device is comprised of a rotating plate with an essentially vertical yet slightly inclined axis of rotation.

10. A device as claimed in claim 8, wherein the endless conveying device is comprised of a circulating belt which runs above and in a plane with the conveyor belt and diagonally thereto.

11. A device as defined in claim 8, wherein the grippers have at least three uniformly arranged spreader arms which extend outwardly.

12. A device as defined in claim 8, wherein each gripper has a thread stripper.

13. A device as defined in claim 8, wherein the automatic tag-making machine is a separate independent machine which produces rolls of tags.

14. A device as defined in claim 8, further comprising a guide pulley for diverting the support band with the loops and tags from the supporting foil.

15. A device as defined in claim 8, further comprising a guide pulley in the path of the support band after the pick-up point of the loops by the grippers, and at least one rewinding roller for the support band, the support band being turned on the guide pulley by at least 90° and then wound up on the rewinding roller.

* * * * *